US010068735B2

(12) United States Patent
Stifter, Jr. et al.

(10) Patent No.: US 10,068,735 B2
(45) Date of Patent: Sep. 4, 2018

(54) ELECTRICAL SWITCHING APPARATUS, AND OPERATING MECHANISM AND LEVER ASSEMBLY THEREFOR

(71) Applicant: EATON CORPORATION, Cleveland, OH (US)

(72) Inventors: Frank Joseph Stifter, Jr., Coraopolis, PA (US); David Curtis Turner, Imperial, PA (US); William George Eberts, Moon Township, PA (US); Kenneth Martin Fischer, Finleyville, PA (US); Edward Anthony Prince, Aliquippa, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 154 days.

(21) Appl. No.: 15/130,059

(22) Filed: Apr. 15, 2016

(65) Prior Publication Data

US 2017/0301500 A1 Oct. 19, 2017

(51) Int. Cl.
*H01H 71/46* (2006.01)

(52) U.S. Cl.
CPC ..... *H01H 71/46* (2013.01); *H01H 2235/004* (2013.01)

(58) Field of Classification Search
CPC ..... H01H 71/46; H01H 2235/004
USPC ..... 200/335, 239, 244, 248, 250, 238, 288, 200/293, 400–401
See application file for complete search history.

(56) References Cited

U.S. PATENT DOCUMENTS

| | | | | |
|---|---|---|---|---|
| 3,134,879 | A * | 5/1964 | Gauthier | H01H 71/504 200/318 |
| 5,280,258 | A * | 1/1994 | Opperthauser | H01H 3/3021 200/400 |
| 6,015,959 | A * | 1/2000 | Slepian | H01H 3/3015 200/400 |
| 6,452,470 | B1 | 9/2002 | Malingowski et al. | |
| 6,924,445 | B2 | 8/2005 | Bresciani et al. | |
| 7,217,895 | B1 | 5/2007 | Shea et al. | |

* cited by examiner

*Primary Examiner* — Edwin A. Leon
(74) *Attorney, Agent, or Firm* — Eckert Seamans

(57) ABSTRACT

A lever assembly is for an operating mechanism of an electrical switching apparatus. The electrical switching apparatus includes a number of pairs of separable contacts structured to move from a CLOSED position to a TRIPPED OPEN position in response to a trip condition. The operating mechanism has an enclosure member and a number of biasing elements coupled to the enclosure member. The biasing elements are structured to move the separable contacts from the CLOSED position to the TRIPPED OPEN position. The lever assembly includes a lever member structured to engage the enclosure member, and a component located on the lever member. The component is structured to extend through each of the biasing elements in order to lengthen each of the biasing elements when the separable contacts are in the CLOSED position.

20 Claims, 6 Drawing Sheets

ELECTRICAL SWITCHING APPARATUS, AND OPERATING MECHANISM AND LEVER ASSEMBLY THEREFOR

BACKGROUND

Field

The disclosed concept relates to electrical switching apparatus, such as, for example, circuit breakers. The disclosed concept also relates to operating mechanisms for electrical switching apparatus. The disclosed concept further relates to lever assemblies for operating mechanisms.

Background Information

Electrical switching apparatus, such as circuit breakers, are employed in diverse capacities in power distribution systems. A circuit breaker may include, for example, a line conductor, a load conductor, and a pair of separable contacts including a fixed contact and a movable contact, with the movable contact being movable into and out of electrically conductive engagement with the fixed contact. The fixed contact is electrically conductively engaged with one of the line and load conductors, and the movable contact is electrically conductively engaged with the other of the line and load conductors.

Upon initial separation of the movable contact away from the stationary contact, an electrical arc is formed in the space between the contacts. The arc provides a means for smoothly transitioning from a closed circuit to an open circuit, but produces a number of challenges to the circuit breaker designer. Among them is the fact that the arc results in the undesirable flow of electrical current through the circuit breaker to the load. Additionally, the arc, which extends between the contacts, often results in vaporization or sublimation of the contact material itself. Therefore, it is desirable to extinguish any such arcs as soon as possible upon their propagation.

There is thus room for improvement in electrical switching apparatus, and in operating mechanisms and lever assemblies therefor.

SUMMARY

These needs and others are met by embodiments of the disclosed concept, which are directed to an electrical switching apparatus, and operating mechanism and lever assembly therefor.

As one aspect of the disclosed concept, a lever assembly for an operating mechanism of an electrical switching apparatus is provided. The electrical switching apparatus includes a number of pairs of separable contacts structured to move from a CLOSED position to a TRIPPED OPEN position in response to a trip condition. The operating mechanism has an enclosure member and a number of biasing elements coupled to the enclosure member. The biasing elements are structured to move the separable contacts from the CLOSED position to the TRIPPED OPEN position. The lever assembly includes a lever member structured to engage the enclosure member, and a component located on the lever member. The component is structured to extend through each of the biasing elements in order to lengthen each of the biasing elements when the separable contacts are in the CLOSED position.

As another aspect of the disclosed concept, an operating mechanism including an enclosure member, a number of biasing elements, and the aforementioned lever assembly is provided.

As yet another aspect of the disclosed concept, an electrical switching apparatus including a number of pairs of separable contacts and the aforementioned operating mechanism is provided.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

Figure 1:
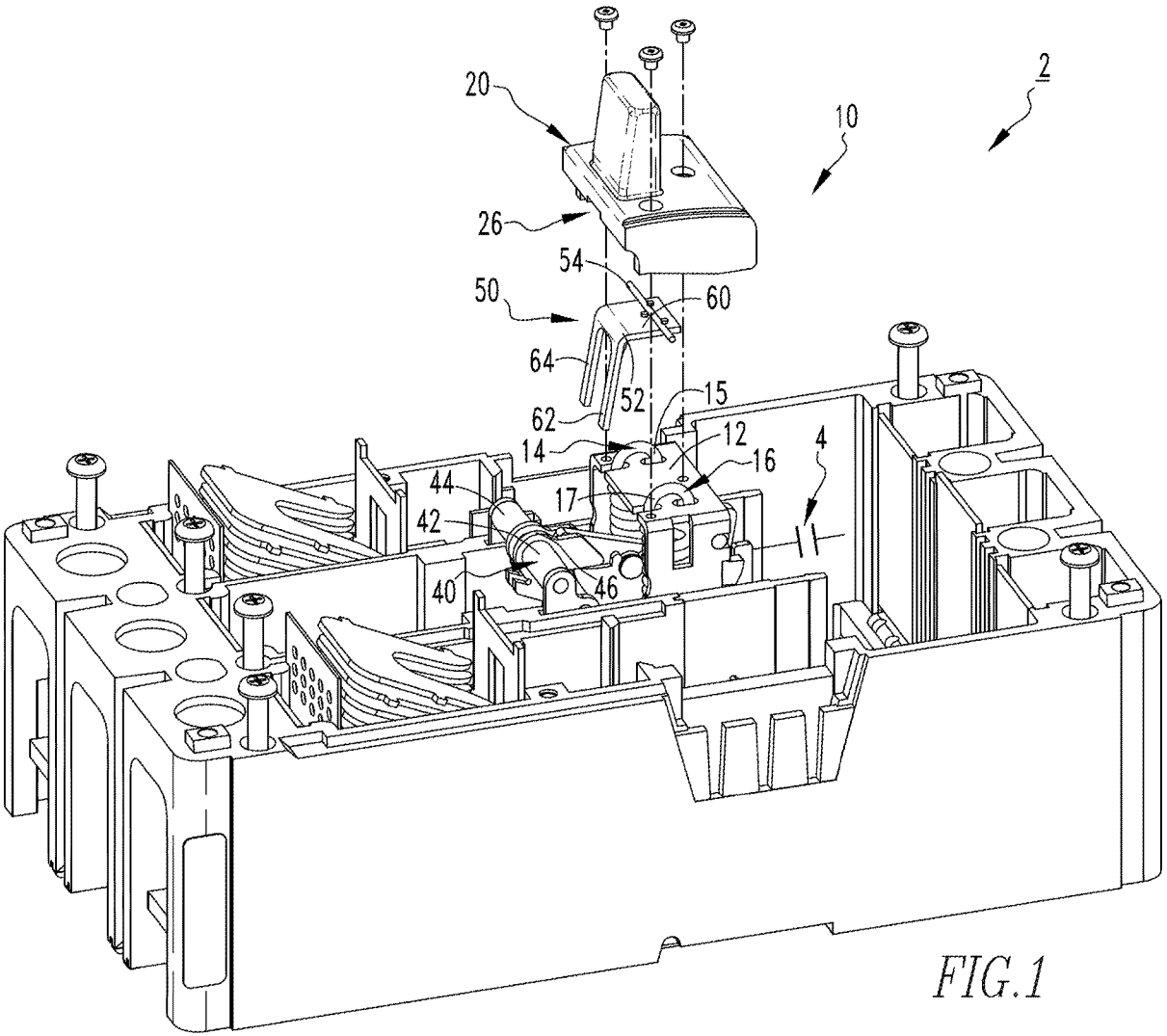
FIG. 1 is an exploded front isometric view of a portion of an electrical switching apparatus, and operating mechanism and lever assembly therefor, shown in the TRIPPED OPEN position, in accordance with a non-limiting embodiment of the disclosed concept.
Figure 2:
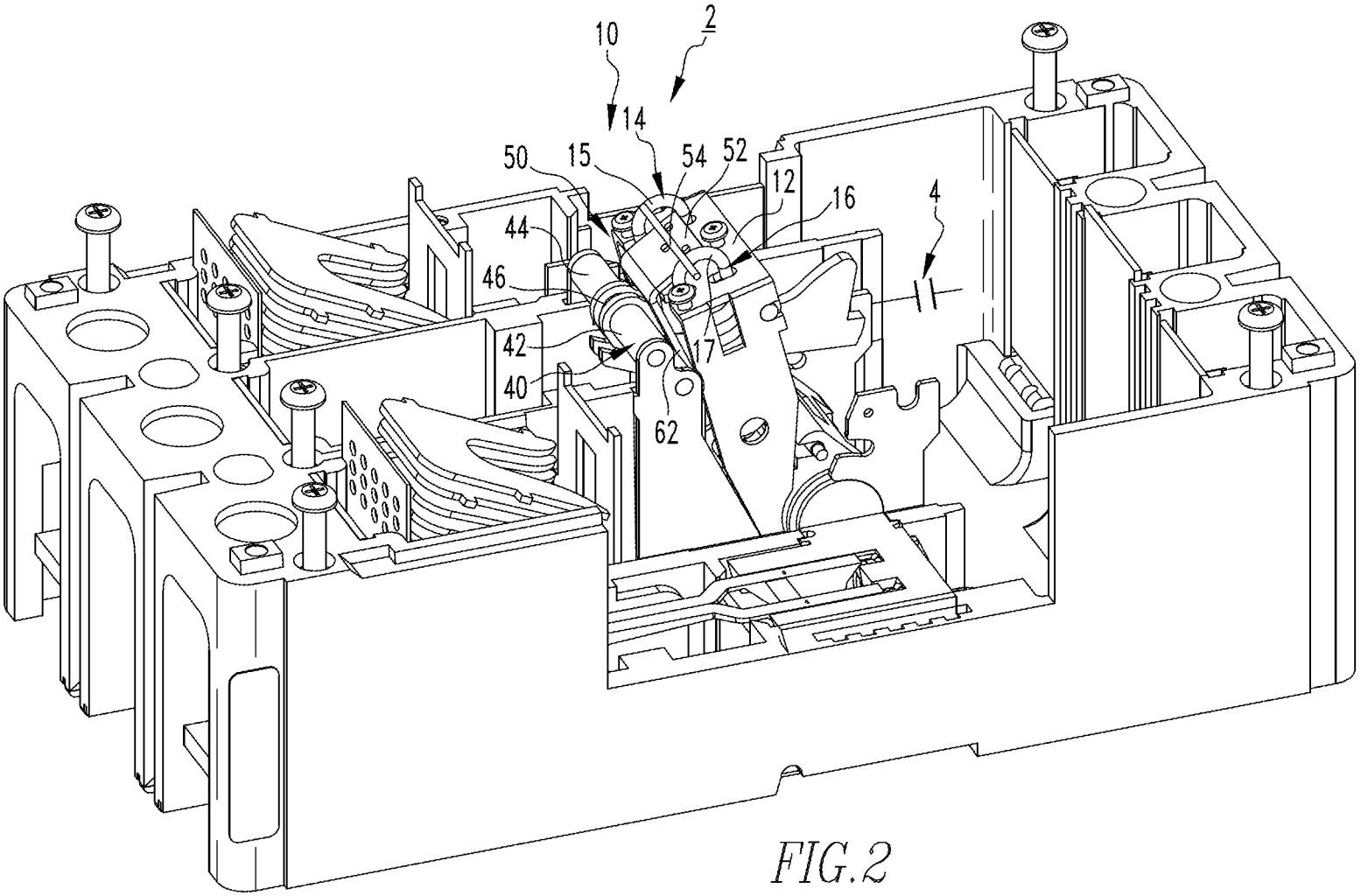
FIG. 2 is an assembled front isometric view of the portion the electrical switching apparatus, and operating mechanism and lever assembly therefor of FIG. 1, shown with portions removed in order to see hidden structures, and shown in the CLOSED position.

FIGS. 1 and 2 show an electrical switching apparatus (e.g., without limitation, molded case circuit breaker 2), in accordance with one non-limiting embodiment of the disclosed concept. The example circuit breaker 2 includes a number of pairs of separable contacts (one pair of separable contacts 4 is shown in simplified form in FIGS. 1 and 2) and an operating mechanism 10 for opening and closing the separable contacts 4. The operating mechanism 10 includes an enclosure member 12, a number of biasing elements (two springs 14,16 are shown in FIGS. 1 and 2) coupled to and being substantially located within the enclosure member 12, a handle arm 20 coupled to the enclosure member 12, a pin member 40, and a lever assembly 50. The handle arm 20 moves into and out of engagement with the pin member 40 during operation of the circuit breaker 2 in a generally well known manner. The springs 14,16 move the separable contacts 4 from a CLOSED position to a TRIPPED OPEN position in response to a trip condition. As will be discussed in greater detail below, the lever assembly 50 provides a novel mechanism to lengthen the springs 14,16 when the separable contacts 4 are in the CLOSED position. In this manner, the springs 14,16 will be able to cause the separable contacts 4 to trip open significantly faster than the separable contacts of prior art circuit breakers (not shown). As a result, electrical arcs caused by the separable contacts 4 tripping open will advantageously be quenched significantly faster in the circuit breaker 2 than in prior art circuit breakers.

Figure 3:
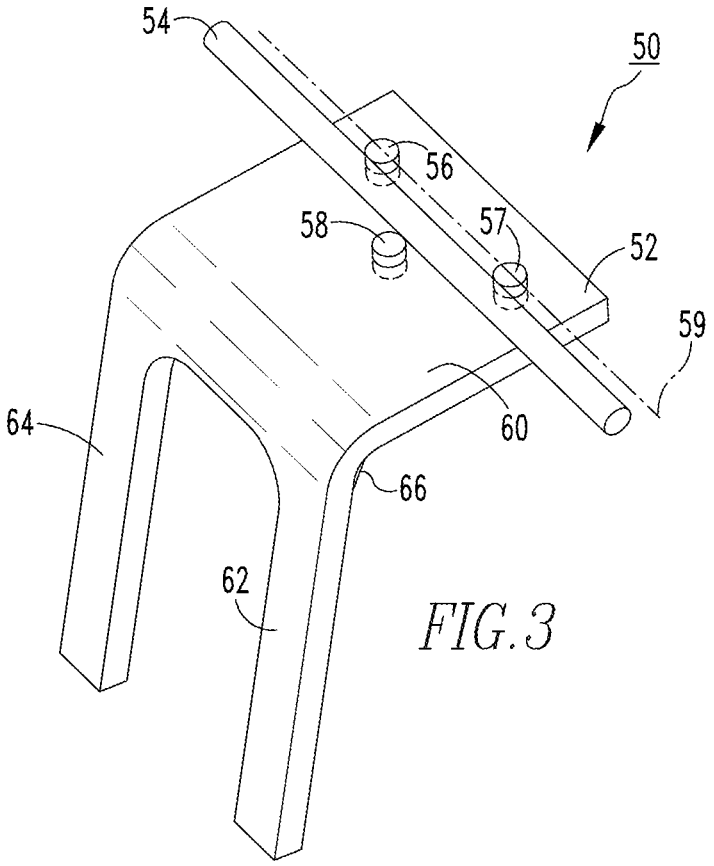
FIG. 3 is a front isometric view of the lever assembly of FIG. 2.
Figure 4:
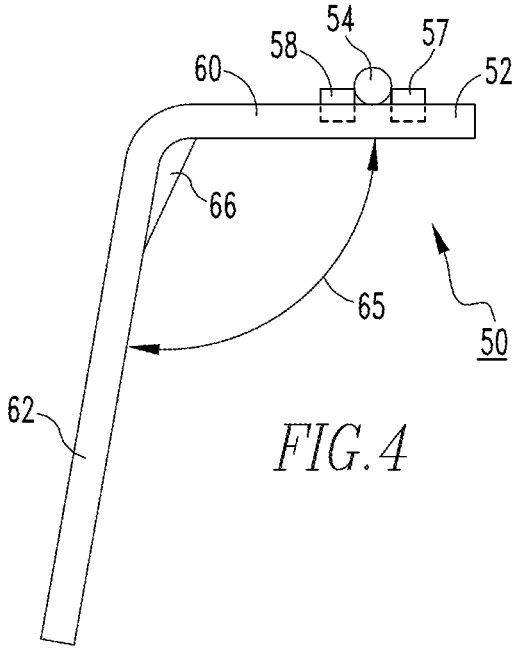
FIG. 4 is a side elevation view of the lever assembly of FIG. 3.

Referring to FIGS. 3 and 4, the lever assembly 50 includes a lever member 52 structured to engage the enclosure member 12 (FIGS. 1 and 2), a component (e.g., without limitation, pin member 54) located on the lever member 52 and engaging the springs 14,16 (FIGS. 1 and 2), and a number of retaining members (three example stud members 56,57,58 are shown) each coupled to the lever member 52. The pin member 54 engages each of the stud members 56,57,58. It will be appreciated that the force of the springs 14,16 on the pin member 54, in combination with the force of the stud members 56,57,58 on the pin member 54, retains the pin member 54 on the lever member 52 in a relatively secure manner. Although the disclosed concept is being described in association with the stud members 56,57,58 being employed to retain the pin member 54 on the lever member 52, it will be appreciated that any suitable alternative configuration and/or combination of components may be employed in order to perform the desired function of retaining the pin member 54 on the lever member 52.

As shown, the stud members 56,57 have a common longitudinal axis 59 and the pin member 54 is parallel to the longitudinal axis 59. Additionally, the pin member 54 is located between the stud member 58 and the longitudinal axis 59. As a result of the configuration of the pin member 54 and stud members 56,57,58, and the geometry of the lever member 52, the circuit breaker 2 is advantageously able to accommodate the lever assembly 50 with relatively minimal modification.

More specifically, the lever member 52 has a generally planar base portion 60 and a number of leg portions (two leg portions 62,64 are shown) extending from the base portion 60 at an angle 65 greater than 90 degrees with respect to the base portion 60. The angle 65 advantageously allows the lever member 52 to be retained in the circuit breaker 2 without modification to internal components of the circuit breaker 2, as will be discussed below. The lever member 52 also includes a number of rib portions 66 (and another rib portion (not shown) for the leg portion 64) each extending from the base portion 60 and a corresponding one of the leg portions 62,64 in order to provide support to the respective leg portions 62,64. As shown, the leg portions 62,64 are spaced from one another.

Referring to FIG. 2, the pin member 40 has a first side portion 42 and a second side portion 44 that are located on opposing sides of a component 46 of the circuit breaker 2. The component 46 is coupled to the pin member 40. In operation, when the separable contacts 4 are in the CLOSED position (FIG. 2), the leg portion 62 engages the side portion 42, and the leg portion 64 engages the side portion 44. Thus, as shown, the lever member 52 avoids interfering with the component 46. In this manner, the spacing of the leg portions 62,64 and the angle 65 together allow the lever member 52 to be maintained within the circuit breaker 2 without modification to the pin member 40 or the component 46.

Figure 5:
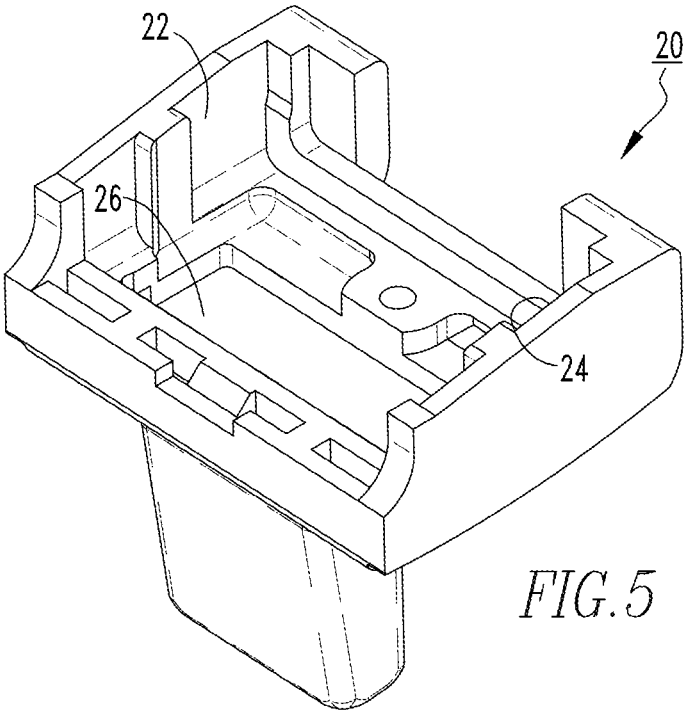
FIG. 5 is a bottom isometric view of a handle arm for the operating mechanism of FIG. 2.
Figure 6:
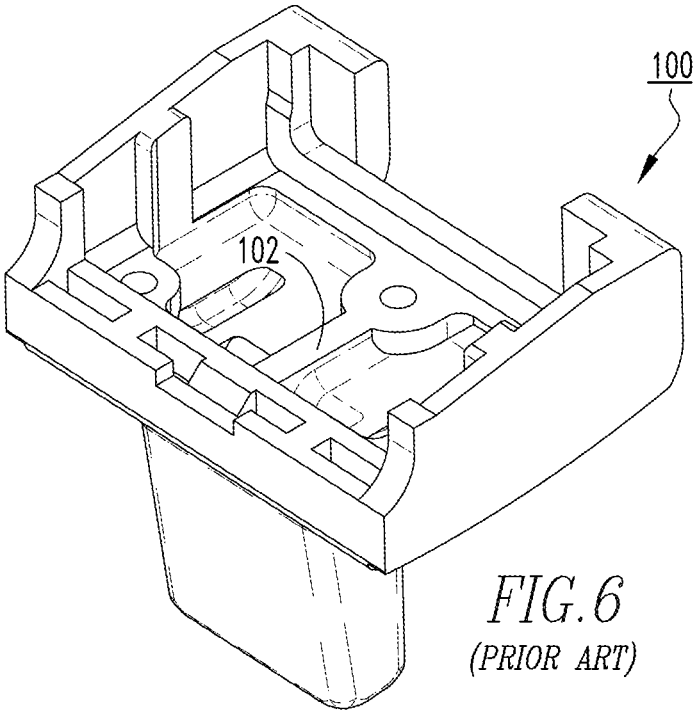
FIG. 6 (PRIOR ART)
FIG. 6 is a bottom isometric view of a prior art handle arm.

Referring to FIG. 5, the handle arm 20 has an interior portion coupled to the enclosure member 12 (FIGS. 1 and 2). The interior portion of the handle arm 20 has opposing distal edge portions 22,24 and a pocket portion 26. The base portion 60 of the lever member 52 is substantially located in and is coupled to the pocket portion 26 (see, for example, FIG. 1). By contrast, FIG. 6 shows a bottom isometric view of a prior art handle arm 100. As shown, the handle arm 100 includes a centrally located rib portion 102. By having the handle arm 20 of the instant invention be devoid of such a rib portion, and rather include the pocket portion 26 extending from proximate the first edge portion 22 to proximate the second edge portion 24, the novel handle arm 20 advantageously accommodates the lever assembly 50. Apart from the novel handle arm 20, the circuit breaker 2 accommodates the lever assembly 50 without requiring undesirable further modification.

Figure 7:
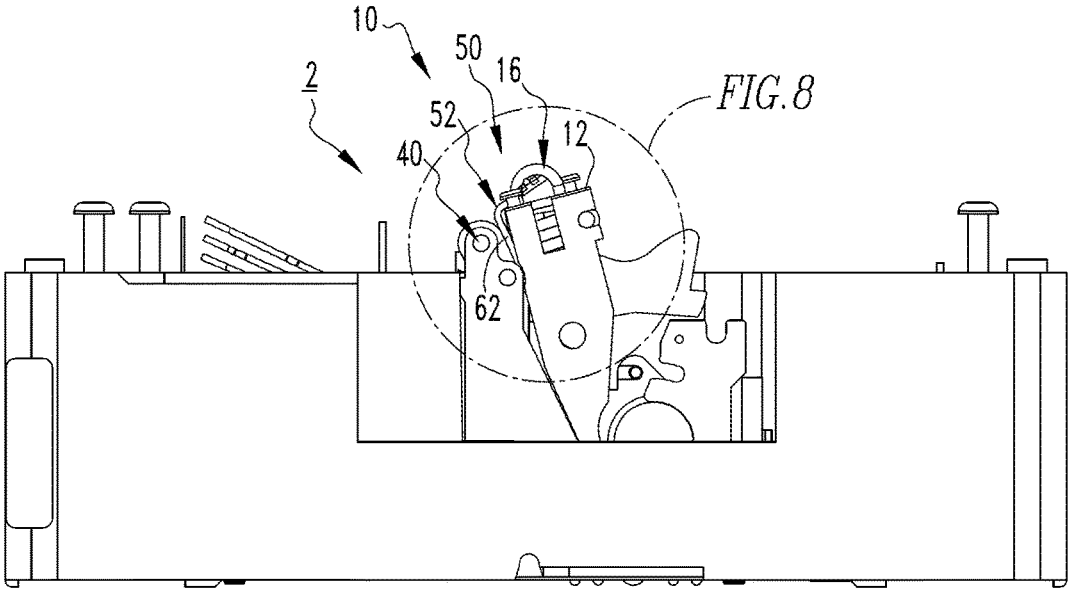
FIG. 7 is a side elevation view of the electrical switching apparatus, and operating mechanism and lever assembly therefor of FIG. 2, shown in the CLOSED position.
Figure 8:
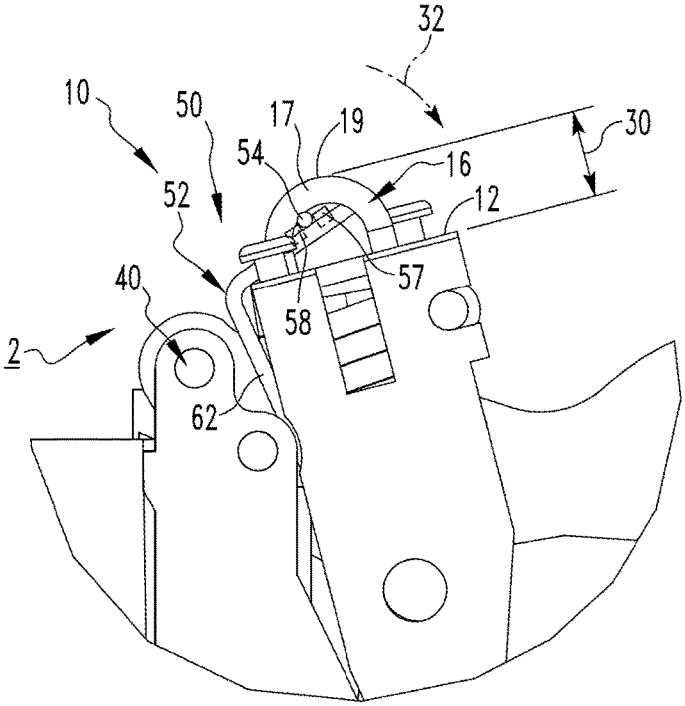
FIG. 8 is an enlarged view of a portion of the electrical switching apparatus, and operating mechanism and lever assembly therefor of FIG. 7.
Figure 9:
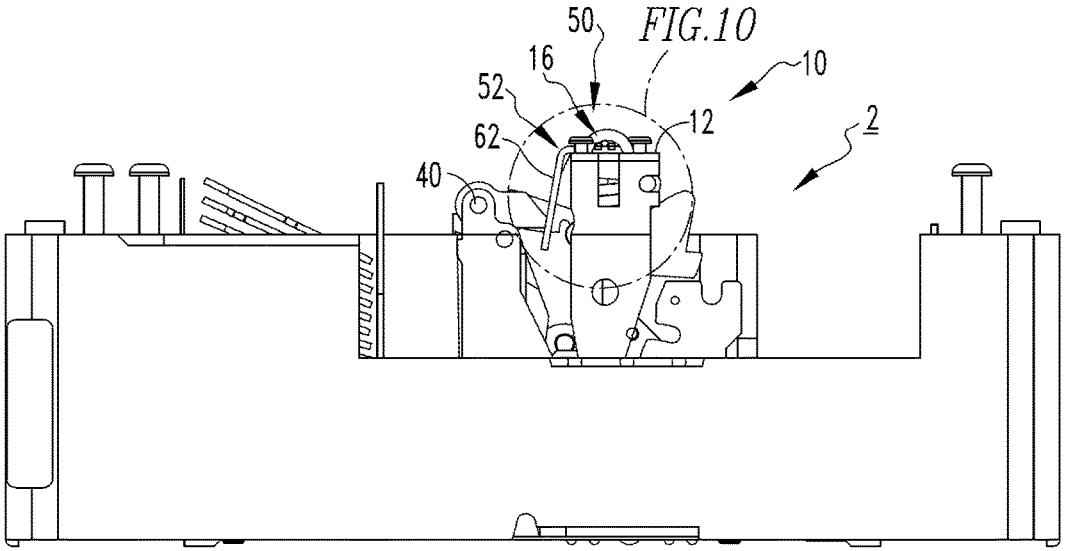
FIG. 9 is a side elevation view of the electrical switching apparatus, and operating mechanism and lever assembly therefor of FIG. 7, shown in the TRIPPED OPEN position.
Figure 10:
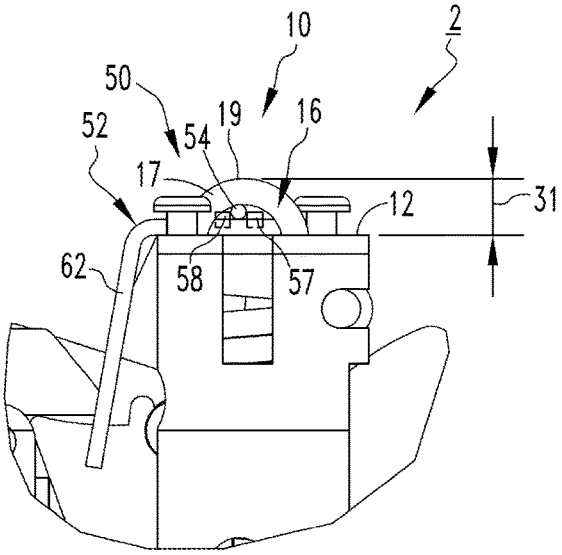
FIG. 10 is an enlarged view of a portion of the electrical switching apparatus, and operating mechanism and lever assembly therefor of FIG. 9.

FIGS. 7 and 8 show the circuit breaker 2 with the separable contacts 4 in the CLOSED position, and FIGS. 9 and 10 show the circuit breaker with the separable contacts 4 in the TRIPPED OPEN position. The springs 14,16 are structured to move between FIRST and SECOND positions corresponding to the separable contacts 4 being in the CLOSED and TRIPPED OPEN positions, respectively. When the springs 14,16 move from the SECOND position toward the FIRST position, a given location of the enclosure member 12 will rotate in a direction (see, for example, direction 32 in FIG. 8) that is located in a plane. It will be appreciated that the pin member 54 is located perpendicular to the aforementioned plane in order to be able to lengthen the springs 14,16.

More specifically, as shown in FIG. 8, the spring 16 has a loop portion 17 and the pin member 54 extends through the loop portion 17, a configuration that allows the spring 16 to be lengthened when the separable contacts 4 are in the CLOSED position. The loop portion 17 has a distal end portion 19, and in the FIRST position the distal end portion 19 is spaced a first distance 30 from the enclosure member 12. Referring to FIG. 10, which shows the spring 16 in the SECOND position, the distal end portion 19 is spaced a second distance 31 from the enclosure member 12. In comparing FIGS. 8 and 10, it can be seen that the first distance 30 is greater than the second distance 31. It will be appreciated that the pin member 54 likewise extends through a corresponding loop portion of the spring 14 (FIGS. 1 and 2) in order to lengthen the spring 14 the same as the spring 16.

Additionally, the pin member 54 extends through and engages the loop portions 17 (and the loop portion of the spring 14) in order to pull the springs 14,16 from the SECOND position (FIGS. 9 and 10) toward the FIRST position (FIGS. 7 and 8). Each of the leg portions 62 (and the leg portion 64, not shown in FIGS. 7-10) extends from the base portion 60 at a respective junction. When the springs 14,16 move from the SECOND position to the FIRST position, the base portion 60 pivots about each respective junction away from the enclosure member 12 in order to allow the pin member 54 to pull the springs 14,16 to the FIRST position. Also, when the springs 14,16 move from the SECOND position toward the FIRST position, the leg portions 62,64 move into engagement with the pin member 40 in order to cause the base portion 60 to pivot about the junctions from which the leg portions 62,64 extend.

Prior art circuit breakers (not shown), by way of contrast, employ springs in which distal end portions are spaced substantially the same distance from enclosure members irrespective of the position of the separable contacts. Thus, the lever assembly 50 provides a novel mechanism to lengthen the springs 14,16 when the springs 14,16 are in the FIRST position corresponding to the separable contacts 4 being CLOSED. The resulting additional tension that is imparted to the springs 14,16 directly corresponds to an increase in tripping speed, which provides significant advantages in terms of arc quenching. Accordingly, the lever assembly 50 allows electrical arcs to be quenched significantly faster in the circuit breaker 2 than prior art circuit breakers, thereby reducing the flow of electrical current through the circuit breaker 2. This improves safety during a trip condition and also prolongs the life of many components of the circuit breaker 2, including the separable contacts 4. Furthermore, the lever assembly 50 provides the aforementioned advantages without requiring different and stronger springs, which might otherwise impart undesirable stresses to a circuit breaker.

Accordingly, it will be appreciated that the disclosed concept provides for an improved (e.g., without limitation, longer lasting, safer) electrical switching apparatus 2, and operating mechanism 10 and lever assembly 50 therefor, in which the lever assembly 50 provides a novel mechanism to lengthen the springs 14,16 of the operating mechanism 10 when the separable contacts 4 are in the CLOSED position. In this manner, tripping speeds are significantly increased by virtue of the additional tension in the springs 14,16. As a result, electrical arcs generated during a tripping event are advantageously able to be quenched relatively fast.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A lever assembly for an operating mechanism of an electrical switching apparatus, said electrical switching apparatus comprising a number of pairs of separable contacts structured to move from a CLOSED position to a TRIPPED OPEN position in response to a trip condition, said operating mechanism comprising an enclosure member and a number of biasing elements coupled to said enclosure member, said number of biasing elements being structured to move said number of pairs of separable contacts from the CLOSED position to the TRIPPED OPEN position, said lever assembly comprising:

a lever member structured to engage said enclosure member; and a component disposed on said lever member, wherein said component is structured to extend through each of said number of biasing elements in order to lengthen each of said number of biasing elements when said number of pairs of separable contacts are in the CLOSED position, wherein said lever member comprises a base portion and a number of leg portions; and wherein said leg portions are fixed with respect to said base portion.

2. The lever assembly of claim 1 further comprising a number of retaining members each coupled to said lever member; and wherein said component is a pin member engaging each of said number of retaining members in order to be retained on said lever member.

3. The lever assembly of claim 2 wherein each of said number of retaining members is coupled to said base portion; and wherein each of said number of leg portions extends from said base portion at an angle greater than 90 degrees with respect to said base portion.

4. The lever assembly of claim 3 wherein said number of leg portions comprises a first leg portion and a second leg portion spaced from said first leg portion.

5. The lever assembly of claim 3 wherein said lever member further comprises a number of rib portions each extending from said base portion to a corresponding one of said number of leg portions.

6. The lever assembly of claim 2 wherein said number of retaining members comprises a first retaining member, a second retaining member, and a third retaining member; wherein said first retaining member and said second retaining member have a common longitudinal axis; wherein said component is a pin member disposed parallel to the longitudinal axis; and wherein said pin member is disposed between the longitudinal axis and said third retaining member.

7. An operating mechanism for an electrical switching apparatus, said electrical switching apparatus comprising a number of pairs of separable contacts structured to move from a CLOSED position to a TRIPPED OPEN position in response to a trip condition, said operating mechanism comprising:

an enclosure member;

a number of biasing elements coupled to said enclosure member, said number of biasing elements being structured to move said number of pairs of separable contacts from the CLOSED position to the TRIPPED OPEN position; and a lever assembly comprising:

a lever member engaging said enclosure member, and a component disposed on said lever member, wherein said component extends through each of said number of biasing elements in order to lengthen each of said number of biasing elements when said number of pairs of separable contacts are in the CLOSED position, wherein said lever member comprises a base portion and a number of leg portions; and wherein said leg portions are fixed with respect to said base portion.

8. The operating mechanism of claim 7 wherein each of said number of biasing elements is structured to move between a FIRST position corresponding to said number of pairs of separable contacts being in the CLOSED position, and a SECOND position corresponding to said number of pairs of separable contacts being in the TRIPPED OPEN position; wherein each of said number of biasing elements has a respective distal end portion; wherein, when each of said number of biasing elements is in the FIRST position, said respective distal end portion is spaced a first distance from said enclosure member; wherein, when each of said number of biasing elements is in the SECOND position, said respective distal end portion is spaced a second distance from said enclosure member; and wherein the first distance is greater than the second distance.

9. The operating mechanism of claim 8 wherein said number of biasing elements comprises a first spring and a second spring each having a loop portion; and wherein said component extends through the loop portion of said first spring and the loop portion of said second spring in order to pull said first spring and said second spring from the SECOND position toward the FIRST position.

10. The operating mechanism of claim 8 further comprising a pin member and a handle arm structured to move into and out of engagement with said pin member; wherein said handle arm is coupled to said enclosure member; wherein each of said number of leg portions extends from said base portion at a respective junction; wherein, when said number of biasing elements move from the SECOND position toward the FIRST position, said base portion pivots about each respective junction away from said enclosure member.

11. The operating mechanism of claim 10 wherein said number of leg portions comprises a first leg portion and a second leg portion spaced from said first leg portion; and wherein, when said number of biasing elements move from the SECOND position toward the FIRST position, said first leg portion and said second leg portion move into engagement with said pin member in order to cause said base portion to pivot about each respective junction away from said enclosure member.

12. The operating mechanism of claim 8 wherein said enclosure member has a location; wherein, when said number of biasing elements move between the FIRST position and the SECOND position, the location rotates in a plane; and wherein said component is a pin member disposed perpendicular to the plane.

13. The operating mechanism of claim 7 further comprising a handle arm comprising an interior portion coupled to said enclosure member; wherein said interior portion has a first distal edge portion, a second distal edge portion disposed opposite and distal said first distal edge portion, and a pocket portion extending from proximate said first distal edge portion to proximate said second distal edge portion; and wherein said base portion is substantially disposed in said pocket portion.

14. The operating mechanism of claim 7 wherein said lever assembly further comprises a number of retaining members each coupled to said lever member; and wherein said component is a pin member engaging each of said number of retaining members in order to be retained on said lever member.

15. The operating mechanism of claim 14 wherein each of said number of retaining members is coupled to said base portion; and wherein each of said number of leg portions extends from said base portion at an angle greater than 90 degrees with respect to said base portion.

16. The operating mechanism of claim 15 wherein said number of leg portions comprises a first leg portion and a second leg portion spaced from said first leg portion.

17. The operating mechanism of claim 15 wherein said lever member further comprises a number of rib portions each extending from said base portion to a corresponding one of said number of leg portions.

18. The operating mechanism of claim 14 wherein said number of retaining members comprises a first retaining member, a second retaining member, and a third retaining member; wherein said first retaining member and said second retaining member have a common longitudinal axis; wherein said component is a pin member disposed parallel to the longitudinal axis; and wherein said pin member is disposed between the longitudinal axis and said third retaining member.

19. An electrical switching apparatus comprising:

a number of pairs of separable contacts structured to move from a CLOSED position to a TRIPPED OPEN position in response to a trip condition; and an operating mechanism comprising:

an enclosure member, a number of biasing elements coupled to said enclosure member, said number of biasing elements being structured to move said number of pairs of separable contacts from the CLOSED position to the TRIPPED OPEN position, and a lever assembly comprising:

a lever member engaging said enclosure member, and a component disposed on said lever member, wherein said component extends through each of said number of biasing elements in order to lengthen each of said number of biasing elements when said number of pairs of separable contacts are in the CLOSED position, wherein said lever member comprises a base portion and a number of leg portions; and wherein said leg portions are fixed with respect to said base portion.

20. The electrical switching apparatus of claim 19 wherein said electrical switching apparatus is a molded case circuit breaker.

* * * * *